US011774173B2

(12) United States Patent
Minigulov et al.

(10) Patent No.: US 11,774,173 B2
(45) Date of Patent: Oct. 3, 2023

(54) ARCTIC CASCADE METHOD FOR NATURAL GAS LIQUEFACTION IN A HIGH-PRESSURE CYCLE WITH PRE-COOLING BY ETHANE AND SUB-COOLING BY NITROGEN, AND A PLANT FOR ITS IMPLEMENTATION

(71) Applicant: Publichnoe Aktsionernoe Obshchestvo "NOVATEK", Tarko-Sale (RU)

(72) Inventors: Rafail Minigulovich Minigulov, Moscow (RU); Sergei Vladimirovich Rudenko, Miloslavskoe (RU); Oleg Evgenievich Vasin, Moscow (RU); Dmitriy Nikolaevich Gritsishin, Troitsk (RU); Evgeniy Igorevich Sobolev, Moscow (RU)

(73) Assignee: Publichnoe Aktsionernoe Obshchestvo "NOVATEK", Tarko-Sale (RU)

( * ) Notice: Subject to any disclaimer, the term of this patent is extended or adjusted under 35 U.S.C. 154(b) by 0 days.

(21) Appl. No.: 17/940,237

(22) Filed: Sep. 8, 2022

(65) Prior Publication Data

US 2023/0003443 A1 Jan. 5, 2023

Related U.S. Application Data

(62) Division of application No. 16/493,089, filed as application No. PCT/RU2017/000585 on Aug. 10, 2017, now Pat. No. 11,566,840.

(30) Foreign Application Priority Data

Mar. 16, 2017 (RU) ..... RU2017108800

(51) Int. Cl.
*F25J 1/02* (2006.01)
*F25J 1/00* (2006.01)

(52) U.S. Cl.
CPC ..... *F25J 1/0052* (2013.01); *F25J 1/004* (2013.01); *F25J 1/005* (2013.01); *F25J 1/0022* (2013.01);
(Continued)

(58) Field of Classification Search
CPC .. F25J 1/0022; F25J 1/004; F25J 1/005; F25J 1/0052; F25J 1/0072; F25J 1/10085;
(Continued)

(56) References Cited

U.S. PATENT DOCUMENTS 6,253,574 B1 7/2001 Stockmann et al.
6,389,844 B1 5/2002 Klein Nagel Voort
(Continued)

FOREIGN PATENT DOCUMENTS

CN 201532077 U 7/2010
CN 102620460 A 8/2012
(Continued)

OTHER PUBLICATIONS

International Search Report in PCT/RU2017/000585, dated Dec. 14, 2017.
(Continued)

*Primary Examiner* — John F Pettitt, III
(74) *Attorney, Agent, or Firm* — Collard & Roe, P.C.

(57) ABSTRACT

A technology liquefies natural gas. The natural gas liquefaction method pre-cools treated natural gas by ethane evaporation, sub-cools liquefied gas using cooled nitrogen as a refrigerant, reduces liquefied gas pressure, separates non-liquefied gas and diverts liquefied natural gas. Before pre-cooling the natural gas is compressed, ethane is evaporated during the multi-stage pre-cooling of liquefied gas with simultaneous evaporation of ethane using cooled ethane as a refrigerant. Ethane generated by evaporation is compressed, condensed and used as a refrigerant during the
(Continued)

cooling of liquefied gas and nitrogen, with nitrogen being compressed, cooled, expanded and fed to the natural gas sub-cooling stage. The natural gas liquefaction unit contains a natural gas liquefaction circuit, an ethane circuit and a nitrogen circuit. The natural gas liquefaction circuit includes a natural gas compressor, a cooler unit, ethane vaporizers, a closed-end subcooling heat exchanger, and a separator, connected in series.

4 Claims, 1 Drawing Sheet

(52) U.S. Cl.
CPC ..... *F25J 1/0072* (2013.01); *F25J 1/0085* (2013.01); *F25J 1/0205* (2013.01); *F25J 1/025* (2013.01); *F25J 1/0207* (2013.01); *F25J 1/0208* (2013.01); *F25J 1/029* (2013.01); *F25J 1/0265* (2013.01); *F25J 1/0283* (2013.01); *F25J 1/0288* (2013.01); *F25J 2220/64* (2013.01); *F25J 2230/20* (2013.01); *F25J 2230/30* (2013.01); *F25J 2270/08* (2013.01); *F25J 2270/12* (2013.01); *F25J 2270/14* (2013.01); *F25J 2270/42* (2013.01)

(58) Field of Classification Search
CPC ..... F25J 1/0283; F25J 1/0288; F25J 1/029; F25J 1/0207; F25J 1/0208; F25J 1/0209; F25J 1/0204; F25J 2270/12; F25J 2270/14; F25J 2270/08; F25J 2270/42
USPC ..... 62/611
See application file for complete search history.

(56) References Cited

U.S. PATENT DOCUMENTS

| | | | |
|---|---|---|---|
| 9,945,604 | B2 | 4/2018 | Ott et al. |
| 2007/0107464 | A1 | 5/2007 | Ransbarger |
| 2009/0249828 | A1 | 10/2009 | Ransbarger |
| 2015/0204603 | A1 | 7/2015 | Sheng et al. |

FOREIGN PATENT DOCUMENTS

| | | | |
|---|---|---|---|
| CN | 102927791 | A | 2/2013 |
| CN | 204063782 | U | 12/2014 |
| CN | 104520660 | A | 4/2015 |
| CN | 204718299 | U | 10/2015 |
| CN | 105102913 | A | 11/2015 |
| CN | 204785551 | U | 11/2015 |
| CN | 106091574 | A | 11/2016 |
| EA | 012809 | B1 | 12/2009 |
| GB | 1291467 | A | 10/1972 |
| JP | 2016-512595 | A | 4/2016 |
| KR | 10-2011-0079949 | A | 7/2011 |
| KR | 10-2011-0107636 | A | 10/2011 |
| RU | 2344360 | C1 | 1/2009 |
| RU | 2538192 | C1 | 1/2015 |
| WO | 2004/015346 | A1 | 2/2004 |
| WO | 2013/184068 | A1 | 12/2013 |
| WO | 2014/039008 | A1 | 3/2014 |
| WO | 2015/069138 | A2 | 5/2015 |

OTHER PUBLICATIONS

Indian Examination Report dated Feb. 28, 2020 in Indian Application No. 201917039010.
English translation of Chinese Office Action dated Sep. 25, 2020 in Chinese Application No. 201780088426.9.
English translation of Korean Office Action dated Dec. 7, 2020 in Korean Application No. 10-2019-7026927.

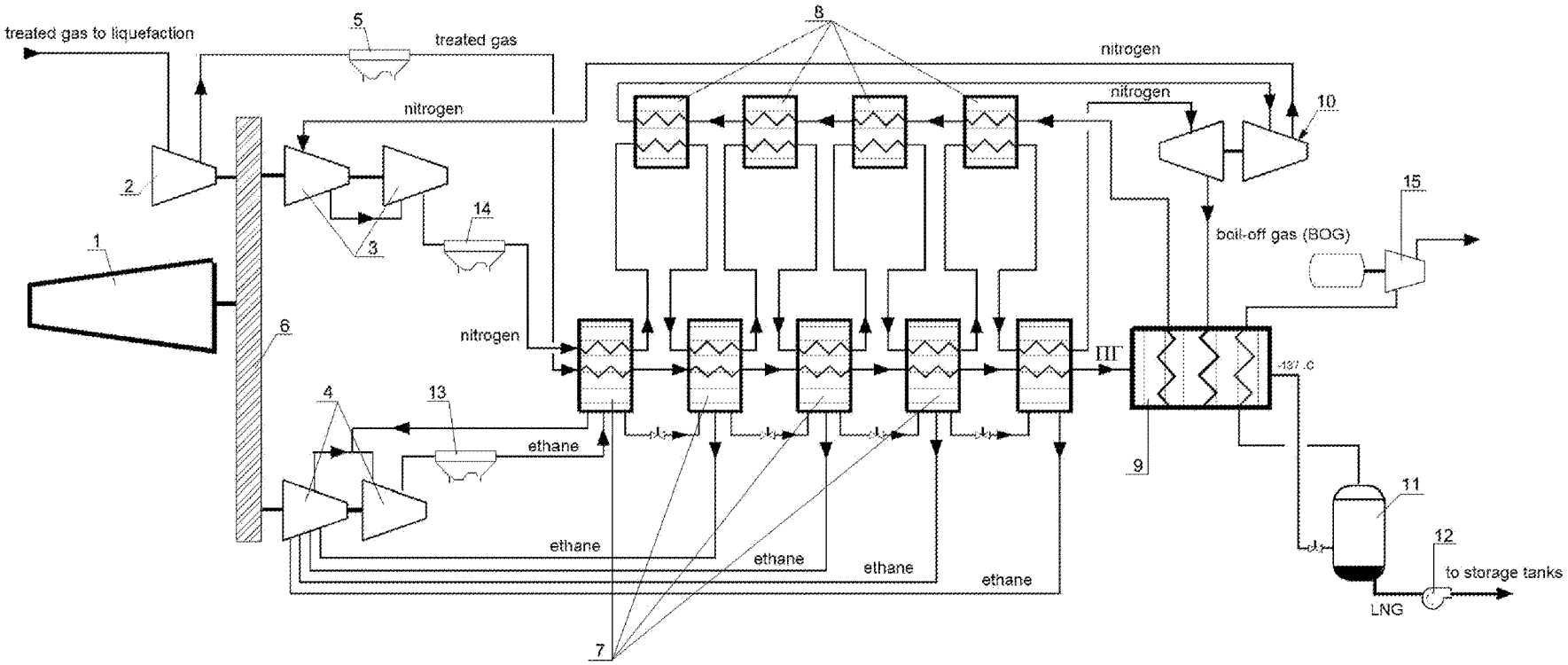
treated gas to liquefaction
treated gas
nitrogen
nitrogen
nitrogen
nitrogen
ethane
ethane
ethane
ethane
ethane
boil-off gas (BOG)
LNG
to storage tanks
III
1
2
3
4
5
6
7
8
9
10
11
12
13
14
15

ARCTIC CASCADE METHOD FOR NATURAL GAS LIQUEFACTION IN A HIGH-PRESSURE CYCLE WITH PRE-COOLING BY ETHANE AND SUB-COOLING BY NITROGEN, AND A PLANT FOR ITS IMPLEMENTATION

CROSS REFERENCE TO RELATED APPLICATIONS

This application is a divisional of and Applicant claims priority under 35 U.S.C. §§ 120 and 121 of U.S. patent application Ser. No. 16/493,089 filed on Sep. 11, 2019, which application is a national stage application under 35 U.S.C. § 371 of PCT Application No. PCT/RU2017/000585 filed on Aug. 10, 2017, which claims priority under 35 U.S.C. § 119 from Russian Patent Application No. 2017108800 filed on Mar. 16, 2017, the disclosures of each of which are hereby incorporated by reference. A certified copy of priority Russian Patent Application No. 2017108800 is contained in parent U.S. patent application Ser. No. 16/493,089. The International Application under PCT article 21(2) was not published in English.

BACKGROUND OF THE INVENTION

1. Field of the Invention

The invention relates to natural gas liquefaction technology for its further transportation by river or sea with subsequent regasification.

2. Description of the Related Art

There are many ways to liquefy natural gas, mainly based on the removal of heat by an external refrigerant, of which C3MR, Philips Cascade, Shell DMR and Linde MFCP liquefaction technologies are used in the Arctic climate.

The C3MR technology is adopted at the NOVATEK, JSC plant in the Yamal Peninsula, Sabetta, at the Yamal LNG project.

Initially, the C3MR process (GB 1291467 A, 04.10.1972) was developed by Air Products for the LNG plant in Brunei. The technology is based on natural gas cooling sequence: first, in three heat exchangers using an independent propane-based vapor compression cycle, and then in a two-zone multi-section heat exchanger using a cycle based on a mixture of refrigerants, which is also pre-cooled using the propane cycle in two heat exchangers.

The C3MR process is used at over 80% of the total number of process trains.

A disadvantage of the process in the Arctic climate is incomplete use of the environment cold. If under the equatorial climate heat removal from gas and mixed refrigerant (MR) in the propane circuit is made within temperature range from +45° C. to −34° C., in the Arctic climate this range may start from +10° C. As a result, main compressor power is spent on compressing the mixed refrigerant of the second circuit. Compressor capacity is linked to the size of gas drives. For a process train with a capacity of 5 million tons per year of liquefied natural gas (LNG), 86 MW drives are used. The maximum use of this power, with a shift of its consumption balance towards the MR, is only possible by increasing weight and size of a main cryogenic heat exchanger.

The Philips Cascade technology is used by Conoco Phillips at several LNG plants (Alaska, Trinidad and Tobago, etc.)

The technology is based on the sequential cooling of gas in three circuits by propane, ethylene and methane. Propane condensation is carried out in air coolers, while ethylene is condensed by propane vapors, and methane is condensed by ethylene vapors.

Natural gas, subject to moisture and carbon dioxide pre-purification, is fed into heat exchangers at a pressure of 41 bar and is supplied to tanks after cooling and throttling. Each circuit provides for a three-fold expansion of refrigerants with return streams being fed to the corresponding stages of multi-stage centrifugal compressors downstream of the heat exchangers. Injection pressure of the compressor propane stage is 15.2 bar, throttling is carried out to pressures of 5.5; 3.15 and 1.37 bar. At the ethylene stage, pressure decreases from 20.5 to 5.5; 2.05 and 1.72 bar, in the last circuit pressure decreases from the pressure of 37.2 bar to pressures of 14.8; 5.8 and 2.05 bar.

A disadvantage of said technology is low pressure of liquefied gas (41 bar), which increases specific energy consumption of the liquefaction process, a large number of equipment, need for third-party ethylene refrigerant supply, a complex scheme for refrigerant stream control comprising 3 three-stage compressors, 9 anti-surge circuits.

Shell implemented the Shell DMR technology (U.S. Pat. No. 6,389,844 A, 21 May 2002) at the Sakhalin LNG plant.

The DMR process uses 2 mixed refrigerants. Gas is liquefied in two circuits, in each of which gas is cooled by mixed refrigerants of different composition. Each circuit uses a multithread coil heat exchanger. In the first circuit, the gas is cooled by refrigerant vapors, previously condensed on the heat exchanger tube side, and a coolant of the second circuit is also cooled. In the second heat exchanger, the gas is sub-cooled at 2 levels of piping with vapors of the second circuit refrigerant condensed in the tube bundle.

The process most closely matches the cold climate. Disadvantage of the process is a complex control scheme of 2 circuits of MR. In practice, transition from one MR composition to another, depending on the time of year, turned out to be hard to predict and is applied at the Sakhalin LNG plant no more than 2-3 times a year.

The Linde MFCP technology (U.S. Pat. No. 6,253,574 A, Jul. 3, 2001) is used by Statoil for natural gas liquefaction at a plant in Hammerfest, Norway.

The MFCP liquefaction process is based on the sequential gas cooling in three circuits with three mixed refrigerants of different composition. The first circuit uses two consecutive plate heat exchangers operating at two pressure levels. The first circuit refrigerant is propane-ethane. Propane-ethane mixture vapors are condensed by seawater, cooled in plate heat exchangers of the first circuit and dissipate cold to the liquefied gas and refrigerant of the second circuit.

The second circuit is designed to liquefy natural gas in a coil heat exchanger using propane-ethane-methane mixture as a refrigerant. In the third circuit, the liquefied gas is sub-cooled with nitrogen-methane-ethane vapors. A coil-wound heat exchanger is used for sub-cooling, as in the second circuit. All three circuits use seawater for preliminary gas cooling.

A disadvantage of the process is a complex control scheme due to the use of three types of mixed refrigerant, as well as large number of types of heat exchange and compressor equipment.

GAO Gazprom patented a natural gas liquefaction method, which consists in cooling and condensing in a pre-cooler of pre-treated and dried natural gas, which is further separated from the liquid ethane fraction sent to fractionation, while a gas stream from the first separator is sequentially cooled in a liquefier heat exchanger using a mixed refrigerant, sub-cooled by gaseous nitrogen in a sub-cooling heat exchanger, while pressure of the sub-cooled LNG is reduced in a liquid expander, and the sub-cooled LNG is sent for separation, after which liquefied gas is delivered to a LNG storage tank, while separated gas is discharged to a fuel gas system. A natural gas liquefaction plant comprises a pre-cooler, five separators, two chokes, a liquefier-exchanger, three compressors designed to compress the mixed refrigerant, five air coolers, two pumps, a liquid expander, a sub-cooling heat exchanger, a turbo expander unit including an expander and a compressor, two nitrogen cycle compressors (RU 2538192 C1, published on 10 Jan. 2017).

A disadvantage of the method and the plant under RU 2538192 C1 is a complex control of pre-cooling circuit. Presence of a liquid phase downstream of each compression stage leads to hard-to-predict changes in functioning of the primary gas cooling circuit in case of a change in any parameter such as air temperature, refrigerant compression ratio, reduction/increase in productivity.

The closest technology and plant for natural gas liquefaction to the proposed method is the natural gas liquefaction technology and plant under OAO Gazprom's patent RU 2538192 C1.

SUMMARY OF THE INVENTION

The technical problem solved by the proposed technology for natural gas liquefaction is simplification of the technological process, operation stability under changing parameters of the liquefaction process and reduced capital expenditure for equipment.

The technical problem is solved by a natural gas liquefaction method, which consists in pre-cooling of treated natural gas by means of ethane evaporation, liquefied gas sub-cooling using cooled nitrogen as a refrigerant, liquefied gas pressure reduction, separation of non-liquefied gas and removal of liquefied natural gas (LNG). The special feature of this method is that prior to pre-cooling the natural gas is compressed, ethane is evaporated during the multi-stage pre-cooling of liquefied gas with simultaneous evaporation of ethane using cooled ethane as a refrigerant, while ethane generated by evaporation is compressed, condensed and used as a refrigerant during the cooling of liquefied gas and nitrogen, with nitrogen being compressed, cooled, expanded and fed to the natural gas sub-cooling stage.

Further, ethane is evaporated in vaporizers connected in series, nitrogen is cooled by alternate feeding to the vaporizers and nitrogen-nitrogen heat exchangers, while nitrogen return stream from a compressed gas heat exchanger is used as refrigerant in the nitrogen-nitrogen heat exchangers.

Further, natural gas is cooled at high pressure in a single-phase state, preventing phase transition processes.

Further, for natural gas pre-cooling ambient air or water of a water basin from Arctic, Antarctic, or close regions is used.

Further, the natural gas sub-cooling process uses liquefied gas in a single-phase critical state as well as gaseous nitrogen.

Further, each cooling apparatus is an air or water cooler using ambient air or water.

The technical problem is also solved by a natural gas liquefaction plant that comprises a natural gas liquefaction line, an ethane circuit and a nitrogen circuit; the natural gas liquefaction line includes a natural gas compressor, an air cooler, ethane vaporizers, a closed-end sub-cooling heat exchanger and a separator connected in series; the ethane circuit includes a series connection of at least one ethane compressor, an air cooler, said ethane vaporizers with outlets connected to inlets of at least one compressor; the nitrogen circuit includes a series connection of at least one nitrogen compressor, an air cooler, said ethane vaporizers, nitrogen-nitrogen heat exchangers connected between said ethane vaporizers, a turboexpander, said closed-end sub-cooling heat exchanger, said nitrogen-nitrogen heat exchangers and a turbocompressor connected to an inlet of the nitrogen compressor.

Further, a separator outlet for non-liquefied boil-off gas (BOG) is connected with the closed-end sub-cooling heat exchanger which has its BOG outlet connected to a BOG compressor.

Further, the turboexpander and the turbocompressor are combined into an expander-compressor unit.

Further, a drive of all compressors is a gas turbine engine connected to a multiplier connected to each compressor.

The technical result achieved when using the proposed method and device is as follows.

Compared to OAO Gazprom technology, the proposed Arctic Cascade technology uses pure ethane refrigerant, instead of the mixed refrigerant (MR), in the first liquefaction circuit. This solution greatly simplifies the liquefaction process, allows the use of simple vaporizers instead of complex multithread heat exchangers for the mixed refrigerant, expands the list of plants capable of manufacturing necessary equipment.

The use of ethane for pre-cooling, instead of MR, helps to decrease capital costs for refrigerant fractionation unit, to reduce sizes of a storage warehouse, to exclude from the scheme a pure refrigerants' mixing unit for MR preparation.

With a much simpler process scheme, energy consumption of the liquefaction process under the Arctic Cascade technology and RU 2538192 C1 are similar for an ambient air temperature of +5° C. and are approximately 240 kW per one ton of LNG.

The Arctic Cascade technology implements a single drive for one production line, which distributes its power through a multiplier, while the technology patented under RU 2538192 C1 applies two drives, which increases cost and quantity of equipment.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings,

The sole FIGURE presents a schematic diagram of the proposed plant, explaining the proposed method of natural gas liquefaction.

DETAILED DESCRIPTION OF PREFERRED EMBODIMENTS

A natural gas liquefaction line comprises a natural gas compressor 2, an air cooler 5, ethane vaporizers 7, a closed-end sub-cooling heat exchanger 9, for example, a multi-thread one, and a separator 11, connected in series.

An ethane circuit comprises at least one ethane compressor 4 (two compressors 4 connected in series are shown in the sole FIGURE), an air cooler 13, and said vaporizers 7, outlets of which are connected to inputs of at least one compressor 4, connected in series. As is shown on the diagram, an outlet of the first vaporizer 7 is connected to an inlet of the second compressor 4, while outlets of remaining vaporizers 7 are connected to steps of the first compressor 4.

A nitrogen circuit includes at least one nitrogen compressor 3 (two compressors 3 connected in series are shown in the sole FIGURE), an air-cooler 14, said ethane vaporizers 7, between which nitrogen-nitrogen heat exchangers 8 are connected, a turboexpander of an expander-compressor unit 10, said closed-end sub-cooling heat exchanger 9, said nitrogen-nitrogen heat exchangers 8 and a turbocompressor of the expander-compressor unit 10 connected to an inlet of the first nitrogen compressor 3.

A BOG outlet of a separator 11 is connected with the closed-end sub-cooling heat exchanger 9 which has its BOG outlet connected to a BOG compressor 15.

Further, a drive of all compressors 2, 3, 4 is a gas turbine engine 1 connected to a multiplier 6 that distributes power to each compressor 2, 3, 4.

The natural gas liquefaction method is as follows.

The natural gas (NG) pretreated for liquefaction (with vapors of water, carbon dioxide and other contaminants removed) is fed to the natural gas compressor 2, compressed to required pressure, cooled by the ambient cold in the air or water cooler unit or units 5, to a temperature c. +10° C. and sent to the ethane vaporizers 7 for pre-cooling. After sequential cooling in the vaporizers 7, the gas with a temperature c. −84° C. is fed to the closed-end gas sub-cooling heat exchanger 9 where it is sub-cooled with nitrogen and BOG to a temperature of c. −137° C. Then the gas pressure is reduced at the throttle to c. 0.15 MPag, while its temperature drops to c. −157° C., after which the gas-liquid stream enters the end separator 11. From the separator 11 LNG is supplied to storage tanks by a pump 12, while the non-liquefied part of the gas is delivered to the end heat exchanger 9, dissipates cold to the liquefied gas stream and is compressed by the BOG compressor 15 to a pressure of c. 3.0 MPag. Part of the boil-off gas is delivered to a unit fuel system, while another part goes to recycling at the start of the liquefaction process.

The pre-cooling circuit uses ethane as the refrigerant. Gaseous ethane from vaporizers 7 with different pressures enters the multistage compressor 4 (compressors), where it is compressed to a pressure of c. 3 MPag, and is condensed in air coolers 13 at a temperature of +10° C. and lower. Liquid ethane is sent to the vaporizers 7, where nitrogen cools the gas to a temperature of c. —84° C., at various pressure levels. The gaseous ethane from the vaporizers 7 is fed to the compressor 4 (compressors) and further along the cycle.

The nitrogen compressed by compressors 3 to c. 10 MPa is cooled in air-coolers 14, alternately enters ethane vaporizers 7 and nitrogen-nitrogen heat exchangers 8, and, cooled by the nitrogen return stream and in ethane vaporizers 7 to a temperature of c. −84° C., enters the turboexpander, where the nitrogen booster turbocompressor serves as a load in the expander-compressor unit 10. After reducing the expander pressure to 2.6 MPa and cooling to −140° C., the nitrogen enters the closed-end multithread sub-cooling heat exchanger 9. After dissipating cold to the liquefied gas stream, the nitrogen passes through recuperative nitrogen-nitrogen heat exchangers 8, enters the turbocompressor of the expander-compressor unit 10, is compressed to a pressure of c. 3 MPag, enters the inlet of the compressor 3, is additionally compressed to 10 MPag and is sent to the cycle.

The process operates in nominal mode at an ambient temperature of +5° C. and below. At temperatures above +5° C., the performance of the process train starts declining. Since the technology is developed for the Arctic and Antarctic latitudes, the waters of the Arctic or Antarctic seas, bays and other water bodies, which have low temperatures even in summer, can also be used for ethane condensation in units 13 in a hot summer period.

In order to optimize the kinematic circuit and to reduce the quantity of rotating equipment, all the compressors 2, 3, 4 used for gas, ethane and nitrogen compressing can be driven by a single gas turbine engine 1, with power to be distributed to each compressor through the multiplier 6.

The estimated energy consumption of LNG production using the Arctic Cascade technology is about 220 kW per ton.

Although only a few embodiments of the present invention have been shown and described, it is to be understood that many changes and modifications may be made thereunto without departing from the spirit and scope of the invention.

What is claimed is:

1. A natural gas liquefaction method, which comprises compression of treated natural gas, multi-stage pre-cooling the compressed natural gas by means of evaporation of ethane in vaporizers connected in series, the ethane being used as a first refrigerant, sub-cooling the pre-cooled natural gas using cooled nitrogen as a second refrigerant, reducing pressure of the sub-cooled natural gas to form a reduced pressure mixture, separating the reduced pressure mixture into a non-liquefied natural gas and a liquefied natural gas, wherein the ethane after the evaporation is compressed, condensed and then used for the evaporation, the nitrogen is compressed, cooled by alternate feeding to the vaporizers and to nitrogen-nitrogen heat exchangers, expanded and then used for sub-cooling of the pre-cooled natural gas, further the nitrogen after the sub-cooling is used as a cooling agent in the nitrogen-nitrogen heat exchangers.

2. The method according to claim 1, wherein during the multi-stage pre-cooling the natural gas is in a single-phase state, preventing phase transition processes.

3. The method according to claim 1, wherein before the multi-stage pre-cooling the natural gas is cooled by ambient air or water of a water basin from Arctic, Antarctic, or close regions.

4. The method according to claim 1, wherein during the sub-cooling the non-liquefied natural gas in a single-phase critical state is used as a third refrigerant.

* * * * *